US009834362B1

(12) United States Patent
Stilson et al.

(10) Patent No.: US 9,834,362 B1
(45) Date of Patent: Dec. 5, 2017

(54) MULTI-CHAMBERED SUBSTANCE CONTAINER

(71) Applicant: Mixt Beverages, Inc., Santa Cruz, CA (US)

(72) Inventors: Edward Vincent Stilson, Santa Cruz, CA (US); Alec Morgan Clark, Santa Cruz, CA (US); JoeBen Bevirt, Santa Cruz, CA (US); Gregory Cole DiMaggio, Irvine, CA (US)

(73) Assignee: MIXT BEVERAGES, INC., Santa Cruz, CA (US)

( * ) Notice: Subject to any disclaimer, the term of this patent is extended or adjusted under 35 U.S.C. 154(b) by 0 days.

(21) Appl. No.: 14/876,498

(22) Filed: Oct. 6, 2015

Related U.S. Application Data

(60) Provisional application No. 62/060,096, filed on Oct. 6, 2014.

(51) Int. Cl.
*B65D 25/08* (2006.01)
*B65D 81/32* (2006.01)
*B65D 41/04* (2006.01)

(52) U.S. Cl.
CPC ..... *B65D 81/3211* (2013.01); *B65D 25/08* (2013.01); *B65D 41/04* (2013.01)

(58) Field of Classification Search
CPC ..... B65D 81/3211; B65D 41/04; B65D 25/08
USPC ..... 206/219–222
See application file for complete search history.

(56) References Cited

U.S. PATENT DOCUMENTS 1,585,912 A * 5/1926 Heublein ..... B65D 81/3277 206/222
5,992,677 A 11/1999 Ebine
2005/0279653 A1* 12/2005 Williams-Lucas . B65D 51/2892 206/219
2010/0005811 A1* 1/2010 Jaffe ..... B67D 1/0869 62/3.64
2012/0217178 A1* 8/2012 Rohr ..... B65D 41/04 206/219

OTHER PUBLICATIONS

"Activate Drinks," Facebook, 2015, 14 pages, [Online] [Retrieved on Nov. 18, 2015] Retrieved from the Internet<URL:https://www.facebook.com/activatedrinks>.

(Continued)

*Primary Examiner* — J. Gregory Pickett
*Assistant Examiner* — Rafael Ortiz
(74) *Attorney, Agent, or Firm* — Fenwick & West LLP

(57) ABSTRACT

A container includes an upper chamber, a lower chamber, and a physical actuator, and may include chambers. Each chamber includes a different substance. Each chamber is sealed off from adjacent chambers and the atmosphere. At least one of the chambers is sealed at below atmospheric pressure, which helps hold that chamber in contact with one or more of the other chambers. When the physical actuator is activated, the seals between the chambers are opened to each other and atmosphere, which causes the substances to mix together in the chamber that was previously maintained at below atmospheric pressure. The change in pressure differential also assists in the mixing.

10 Claims, 8 Drawing Sheets

(56) References Cited

OTHER PUBLICATIONS

"Ball Resealable End," Ball Packaging Europe, 2 pages, undated, [Online] [Retrieved on Nov. 18, 2015] Retrieved from the Internet<URL: http://www.ball.com/images/ball_com/product_options_files/Ball_Resealable_End_Data_Sheet_BPE_EN.pdf>.
"Ramune," Wikipedia, Last Modified Oct. 28, 2015, 1 page, [Online] [Retrieved on Nov. 18, 2015] Retrieved from the Internet<URL: http://en.wikipedia.org/wiki/Ramune>.
Steeman, A., "Best in Packaging," Sep. 27, 2013, 5 pages, [Online] [Retrieved on Nov. 18, 2015] Retrieved from the Internet<URL:http://bestinpackaging.com/2013/09/27/dual-chamber-dispensing-bottles-part-03/>.

* cited by examiner

MULTI-CHAMBERED SUBSTANCE CONTAINER

CROSS REFERENCE TO RELATED APPLICATIONS

This application claims the benefit of U.S. Provisional Application No. 62/060,096, filed Oct. 6, 2014, which is incorporated by reference in its entirety.

BACKGROUND

This invention relates to physical containers, and particularly to containers for holding and mixing substances.

While there are a wide variety of containers on the market designed to hold gasses, fluids, and semi-fluid substances, there is a need in the art for a low monetary cost, easy to manufacture container that is able to hold multiple separate substances in isolation from each other during transport and storage, and that also allows convenient, reliable, and automatic mixing of the substances upon opening of the container.

DETAILED DESCRIPTION

I. Overview

Figure 1A:
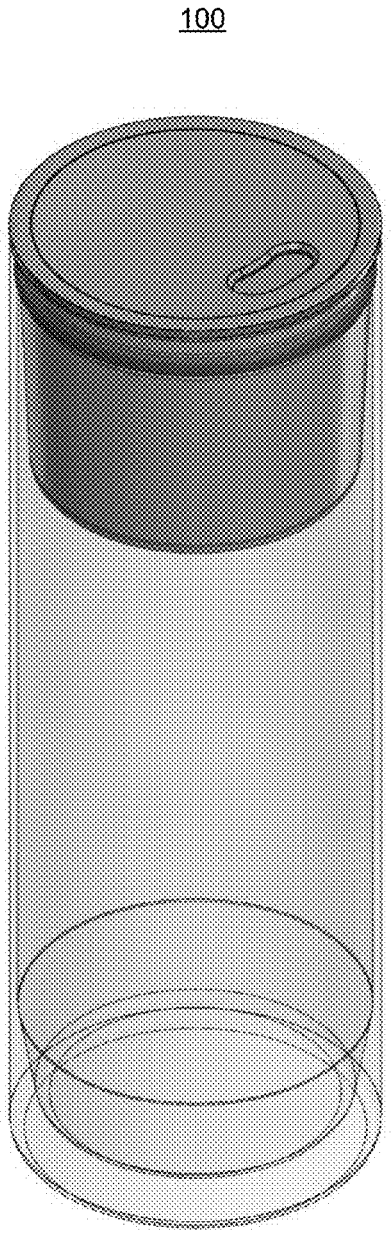
FIG. 1A is a perspective view of a first embodiment of a multi-chambered container.
Figure 1B:
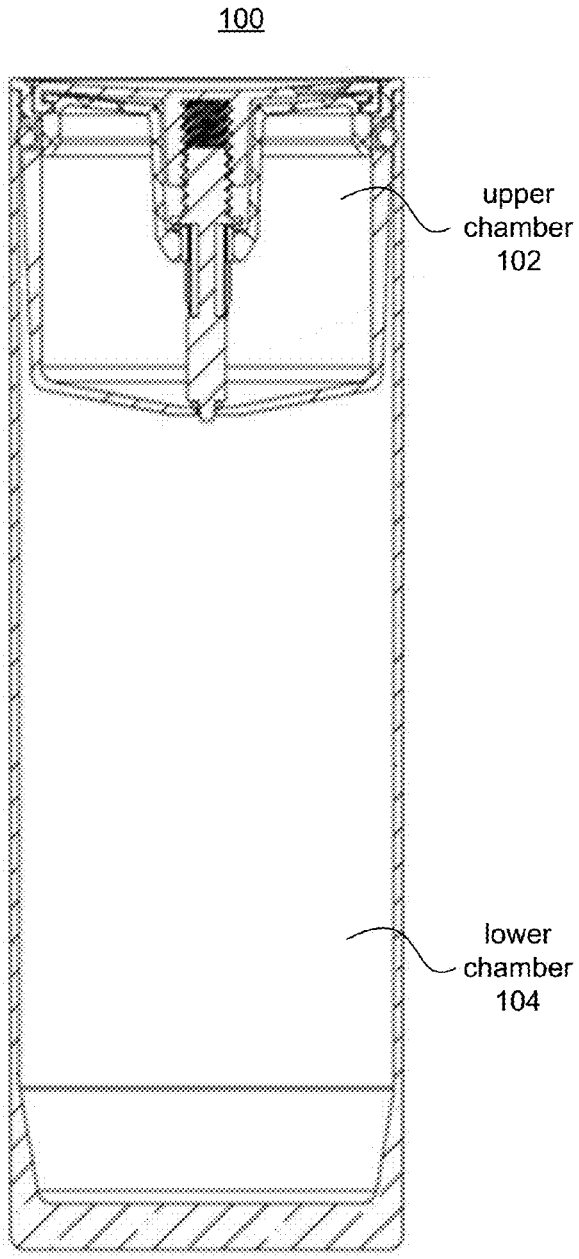
FIG. 1B is a cross sectional side view of the first embodiment of the multi-chambered container in a sealed state.
Figures 1C, 1D:
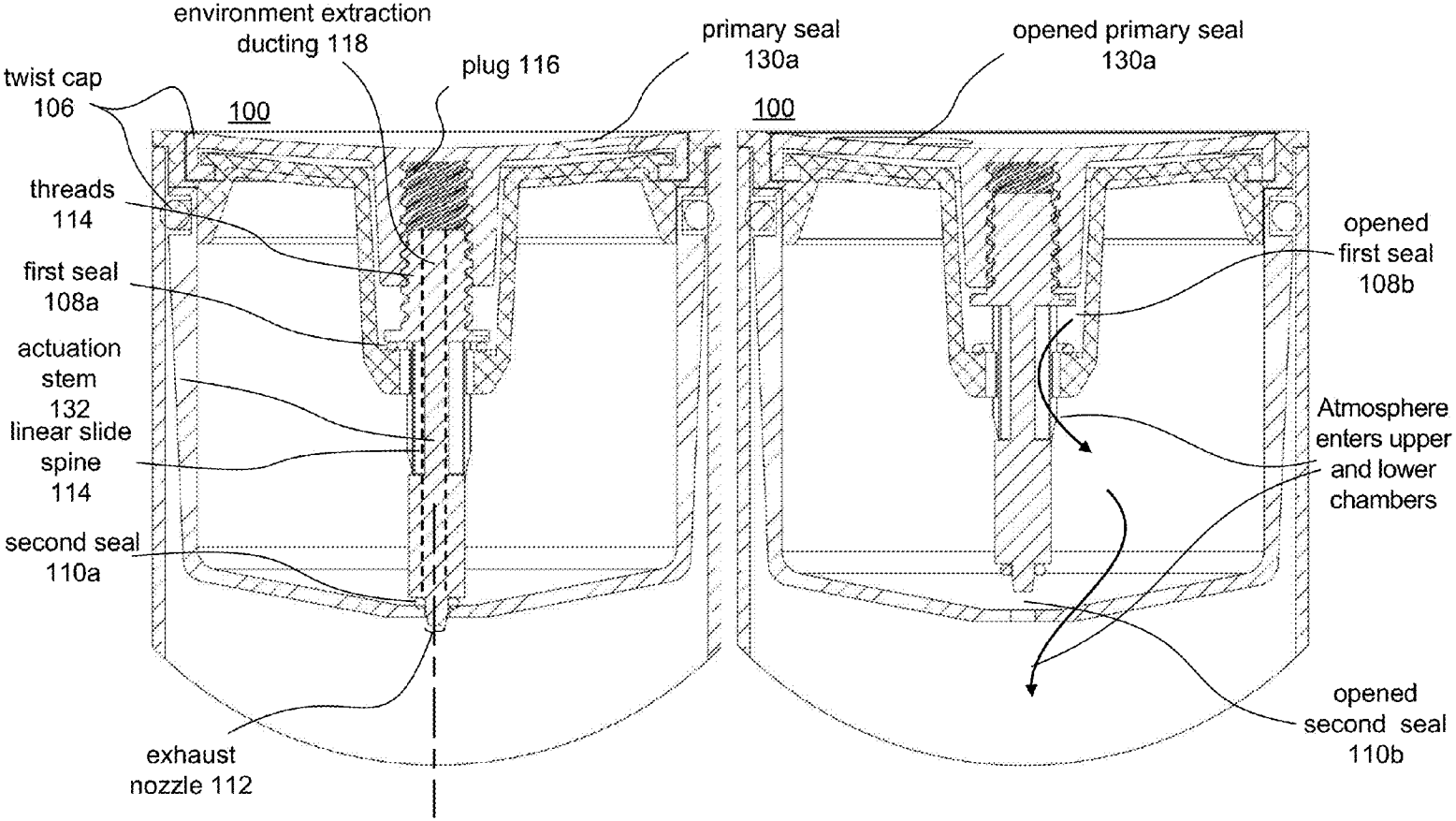
FIG. 1C is an enlarged cross sectional side view of the first embodiment of the multi-chambered container in a sealed state.
FIG. 1D is an enlarged cross sectional side view of the first embodiment of the multi-chambered container in an opened state.

A multi-chambered beverage container is described that, when sealed, separates several different substances into at least two dedicated compartments. The seals in the container may be reusable seals, a one-time (e.g., tearable) seals, or any other kind of vacuum seal. When the end user is ready to consume the product, the container provides a physical actuator for unsealing the compartments, thereby causing the substances in each compartment to mix with one another, resulting in a ratio of substances based on the contents of the compartments prior to unsealing. Prior to opening, at least one of the chambers is sealed at a pressure lower than atmospheric pressure. This not only assists with the mixing of the substances upon opening, but also helps keep the chambers physically connected to each other prior to opening. Additionally, at least one of the chambers other than the one that is maintained below atmospheric pressure may be maintained at atmospheric pressure or higher (e.g., by carbonation).

In an example implementation using two chambers, after unsealing the upper chamber is removable and the mixed substances fill the lower of the two chambers. At this point, the user can dispense the mixed substances (often, but not exclusively, a liquid) from the lower chamber. In a two chamber implementation, the lower chamber is filled with a first substance or set of substances. The upper chamber is filled and sealed with a second, different substance or set of substances. In an implementation having more than two chambers, the additional chambers may contain additional substances. The substances are often in liquid form, though in some embodiments the ingredients may include solids, either in solution or having small volume such that they are capable of being mixed with the substance/s in the lower chamber upon opening. For example, a solid ingredient may dissolve into solution upon contact with the ingredient/s in the lower chamber.

II. Actuation Stem Example Container

FIGS. 1A-1D illustrate different view of a first embodiment of a multi-chambered container. In this first embodiment, the container includes at least two chambers including an upper chamber (also referred to as the secondary chamber) 102 and a lower chamber (also referred to as the reusable chamber, primary chamber, or capsule) 104. The upper 102 and lower 104 chambers of the container are manufactured as physically separate components from each other. The upper chamber 102 is part of an upper assembly (not specifically labeled) of components that includes a cap 106, a primary seal 130 sealing the upper chamber 102 from atmosphere, an actuation stem 132 including a noncircular linear slide spine 114, an exhaust nozzle 112, two different actuation seals 108*a* and 110*a* sealing the lower chamber from the upper chamber and atmosphere (the first 108*a* in contact with the linear slide spine 114, the second 110*a* in contact with the exhaust nozzle 112), and an environment extraction ducting 118 that is a separate air passage in the actuation stem 132 with an opening proximate to atmosphere that is closed by a plug 116. The lower chamber 104 does not necessarily include any other components, though it may in some embodiments.

After manufacturing, a fill process is performed to add substances to the two chambers and then to combine the upper assembly and lower chamber 104 into a sealed/closed state for later use. In one implementation, the upper chamber 102 is filled through the opening in the upper chamber. Carbonation may also be added at this time. The opening may be located on the same side as the primary seal 130, or on any other side of the upper chamber 102. If the opening is located on any other side other than the same side as the primary seal, the cap may also be located on that side or a separate plug (not shown) may be used to plug the opening after filling. FIGS. 1A-1D illustrate an embodiment where the opening is located on the same side as the primary seal 130. The upper chamber 130 is then sealed with the cap. Sealing with the cap additionally secures the cap to the top of the actuation stem 132. The sealing of the cap also causes the bottom of the actuation stem 132 to seal both the first 108*a* and second 110*a* actuation seals. In the illustrated embodiment, the cap is a twist cap 106 having an actuation thread 114 mated to a surface on the upper chamber 102, although this may vary in other embodiments.

Once the upper chamber 102 is filled and sealed, and the lower chamber 104 is filled, the upper assembly and lower chamber 104 are assembled together. In one embodiment, a vacuum line (not shown) is secured to the top of the cap in line with the opening to the environment extraction ducting 118. The vacuum line removes air from the lower chamber 104 through the ducting 118. The vacuum within the lower chamber 104 pulls the upper chamber 102 against the lower chamber 104. The passageway in the ducting 118 is sealed with a plug 116 to maintain the vacuum, and the vacuum line is removed. In an alternate implementation, the container 100 does not include either the ducting 118 or plug 116, and instead the upper assembly and lower chamber are assembled together in an environment that is already below atmospheric pressure. Once assembly is complete, the entire container is removed from the low pressure environment for transport and use by the end user.

The container 100 is opened when the user removes the cap (or more generally, when the physical actuator is actuated). If the cap is a twist cap 106, this occurs when the user rotates the twist cap 106. This action causes an actuation thread 114 within the upper chamber 102 to pull the actuation stem 132 upwards. The actuation stem 132 is constrained along the rotation axis by a noncircular linear slide spine 114. As a result, the actuation stem 132 cannot rotate relative to the upper chamber 102. The combined action translates the actuation stem 132 vertically. The translation of the actuation stem 132 opens the primary seal 130 and both seals 108*b* and 110*b*. The opening of the primary seal 130 opens a ventilation channel thereby allowing atmosphere into the upper chamber 102. The retraction of the exhaust nozzle 112 from the bottom of the upper chamber 102 allows the contents of the upper chamber 102 to enter the lower chamber 104. Collectively, opening these three seals 130*b*, 108*b*, and 110*b* allows atmosphere to also enter the lower chamber 104, thereby increasing the pressure in that chamber from vacuum to atmosphere.

The vacuum that existed in the lower chamber 104 prior to opening exerted a pressure differential on the seal formed at the exhaust nozzle 112. Upon opening, the pressure differential forces the contents of the upper chamber 104 to rapidly vacate the upper chamber in favor of entering the lower chamber 104 to equalize pressure. This creates a mixing effect, resulting in the mixture of the contents from each of the chambers. The mixing effect yields a heterogeneous or homogeneous substance in the lower chamber 104, depending upon the type of substances mixed. Once the contents of the upper chamber 102 have emptied, the upper assembly can be easily removed from the lower chamber 102 as the vacuum no longer strongly holds the upper assembly in place. Once removed, the upper assembly can be either discarded or recycled for reuse.

III. Single Tear Seal Example Container

FIGS. 4A-4F illustrate different views of a fourth embodiment of a multi-chambered container. In this fourth embodiment, the container 400 includes two chambers: an upper chamber 402 and a lower chamber 404. As in the embodiment, the upper 402 and lower 404 chambers of the container 400 are manufactured as physically separate components from each other. In this embodiment, the upper chamber 402 is part of an upper assembly of components that includes a cap, a first actuation seal 408*a* sealing the upper chamber 402 from atmosphere, an environment extraction ducting 418 with an opening 420 proximate to atmosphere that is closed by a plug 416, and a second actuation seal 410*a* sealing the upper chamber 402 from the lower chamber 404. The lower chamber does not necessarily include any other components, though it may in some embodiments.

In one embodiment, the upper chamber 402 and environment extraction ducting 418 are formed of a single part, such as a plastic injected, blow-molded part. The second actuation seal 410*a* is formed at this time as the bottom of the environment extraction ducting 418. The bottom of the upper chamber 402 is formed at this time. This second seal 410*a*, however, is specifically engineered to fail (e.g., tear) when the physical actuator is received to open the container. For example, in an implementation using a twist cap 406, when the twist cap is turned the entirety of the environment extraction ducting 418 rotates due to a press fit between the threads 414 of the twist cap 406 and the corresponding threads on the upper chamber 402. In contrast, the upper chamber 402 itself does not rotate, as it is anchored to the remainder of the bottom and/or sidewalls of the upper chamber 402. This stress ultimately tears the mating point of the bottom of the ducting 418 and the bottom of the upper chamber 402, pulling the ducting 418 upward and breaking the seal 410*b*. The thickness and material of the bottom of the upper chamber 402 may be chosen so as to tear at stresses that can be induced relatively easily by turning of the twist cap 406 by a human user.

After manufacturing, a fill process is performed to add substances to the chambers and then to combine the upper assembly and lower chamber 404 into a sealed/closed state for later use. In one implementation, the upper chamber 402 is filled through the opening in the upper chamber 402. Carbonation may also be added at this time. The opening may be located on the same side as the first seal 408*a*, or on any other side of the upper chamber 402. If the opening is located on any other side other than the first seal, the cap may also be located on that side or a separate plug (not shown) may be used to plug the opening after filling. FIGS. 4A-4F illustrate an embodiment where the opening is located on the same side as the first seal 408*a*. In one specific embodiment, the cap is a twist cap 406 having actuation threads 414 mated to a surface on the upper chamber 402, such when the twist cap 406 is applied, the first seal 408*a* seals the upper chamber from atmosphere. However, in other embodiments other types of caps may be used.

Once the upper chamber 402 is filled and sealed, and the lower chamber 404 is filled separately, the upper assembly (including the upper chamber 402) and lower chamber 402 are assembled together. In one embodiment a vacuum line is secured to the top of the cap in line with the opening 420 in the environment extraction ducting 418. The vacuum line removes air from the lower chamber 404 through the ducting 418. The vacuum within the lower chamber 404 pulls the upper chamber 402 towards the lower chamber 404. The second seal 408*b* on the bottom of the upper chamber 402 mates against the upper side wall of the lower chamber 404, thereby sealing the lower chamber 404 using the trapped vacuum within the lower chamber 404. The ducting 418 is sealed by a plug 416 to maintain the vacuum, and the vacuum line is removed. In an alternate implementation, the container 400 does not include either the ducting 418 or plug 416, and instead the upper assembly and lower chamber are assembled together in an environment that is already below atmospheric pressure. Once assembly is complete, the entire container is removed from the low pressure environment for transport and use by the end user.

The user opens the container 400 by removing the cap. If the cap is a twist cap 406, this occurs when the user rotates the twist cap. This action causes an actuation thread 414 of the cap to retract from corresponding threads (not separately labeled) on the upper chamber 402 to open the first seal 408*b* and also pull the environment extraction ducting 418 up. The opening of the first seal 408*b* opens a ventilation channel thereby allowing atmosphere into the upper chamber 402. The retraction of the environment extraction ducting 418 from the second seal 410*b* causes the engineered failure point on the bottom of the upper chamber 402 previously connected to the ducting 418 to tear, thereby allowing the contents of the upper chamber 402 to enter the lower chamber 404. Collectively, opening these two seals 408*b* and 410*b* allows atmosphere to also enter the lower chamber, thereby increasing the pressure from vacuum to atmosphere.

The vacuum that existed in the lower chamber 404 prior to opening exerted a pressure differential on the second seal 410*a*. Upon opening, the pressure differential forces the contents of the upper chamber 402 to rapidly vacate the upper chamber 402 in favor of entering the lower chamber 404 to equalize pressure. This creates a mixing effect, resulting in the mixture of the contents of the ingredients from each of the chambers. The mixing effect yields a heterogeneous or homogeneous substance in the lower chamber 404, depending upon the type of substances mixed. Once the contents of the upper chamber 402 have emptied, the upper chamber 402 can be easily removed from the lower chamber 404 as the vacuum no longer strongly holds the upper chamber 402 in place. Once removed, the upper chamber 404 can be discarded.

IV. Multiple Tear Seal Example Container

Figure 3A:
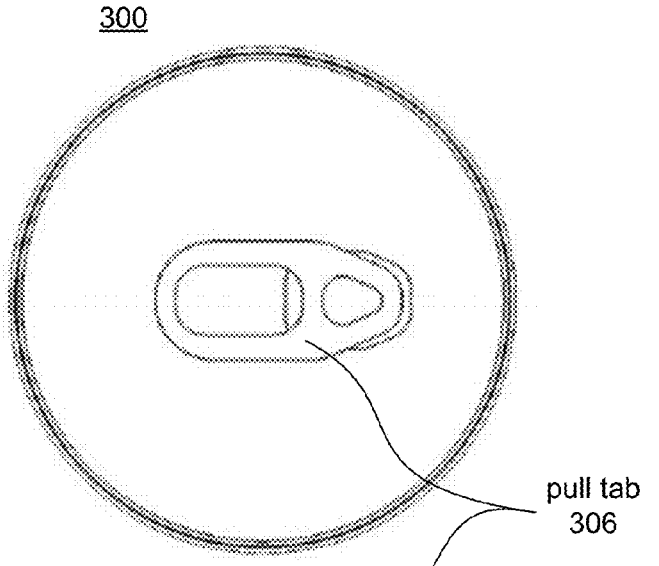
FIG. 3A is a top view of a third embodiment of the multi-chambered container.
Figure 3B:
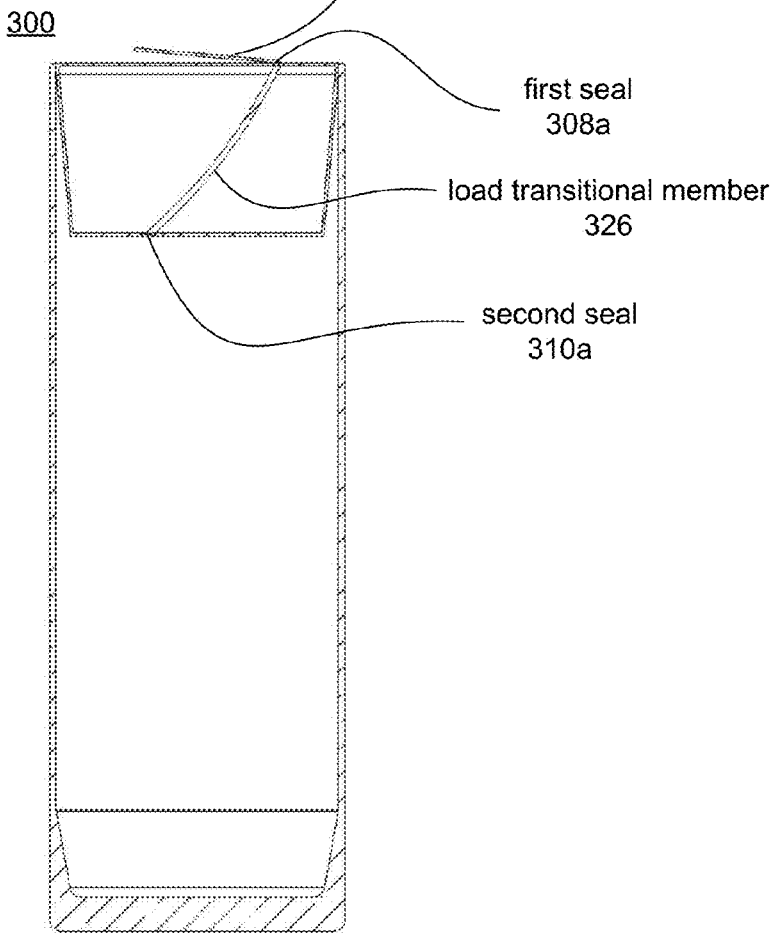
FIG. 3B is a cross sectional side view of the third embodiment of the multi-chambered container in a sealed state.
Figure 3C:
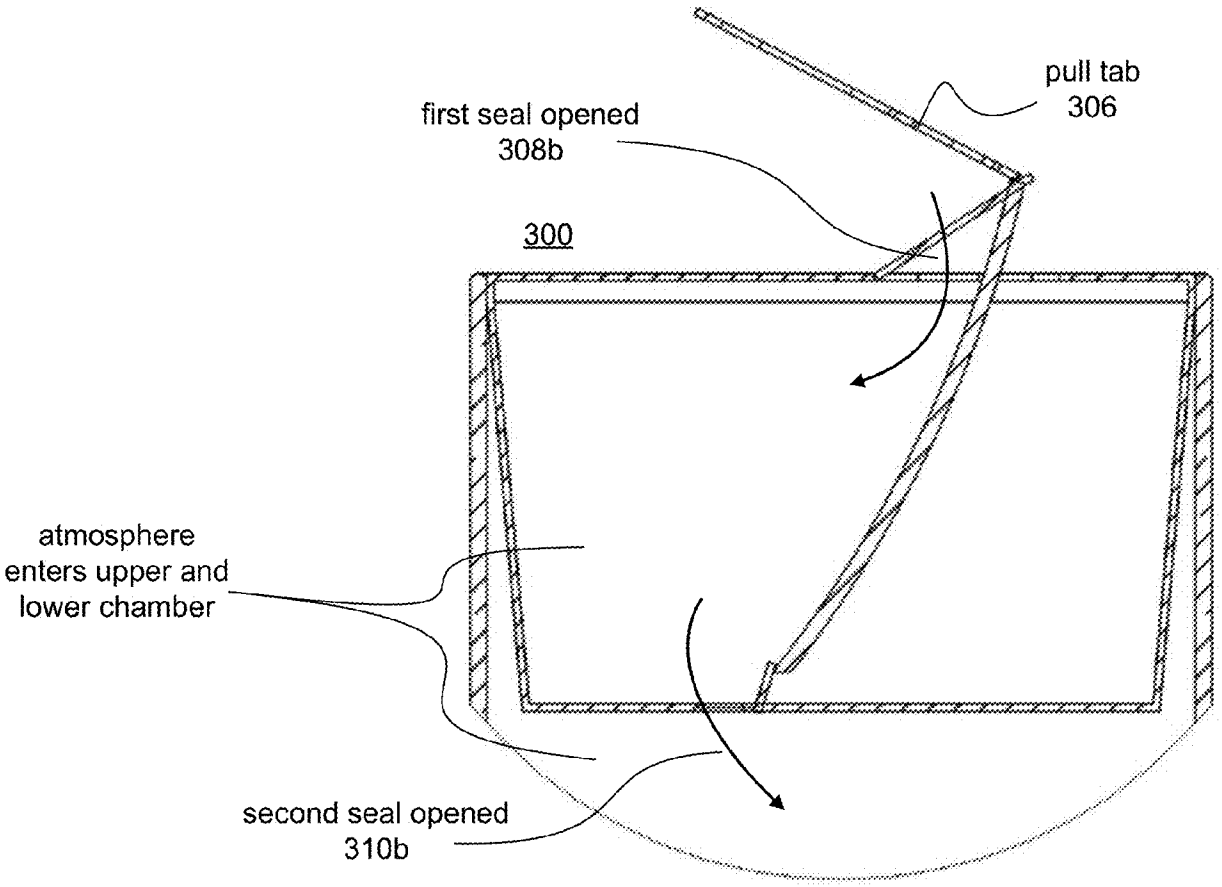
FIG. 3C is an enlarged cross sectional side view of the third embodiment of the multi-chambered container in an opened state.
Figure 4A:
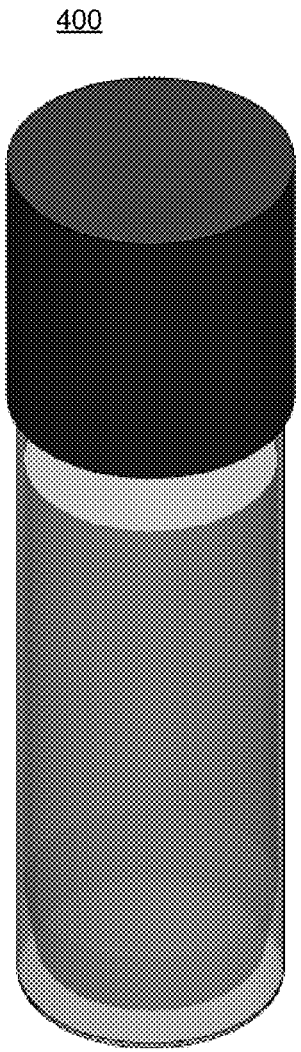
FIG. 4A is a perspective view of a fourth embodiment of a multi-chambered container in a sealed state.
Figure 4B:
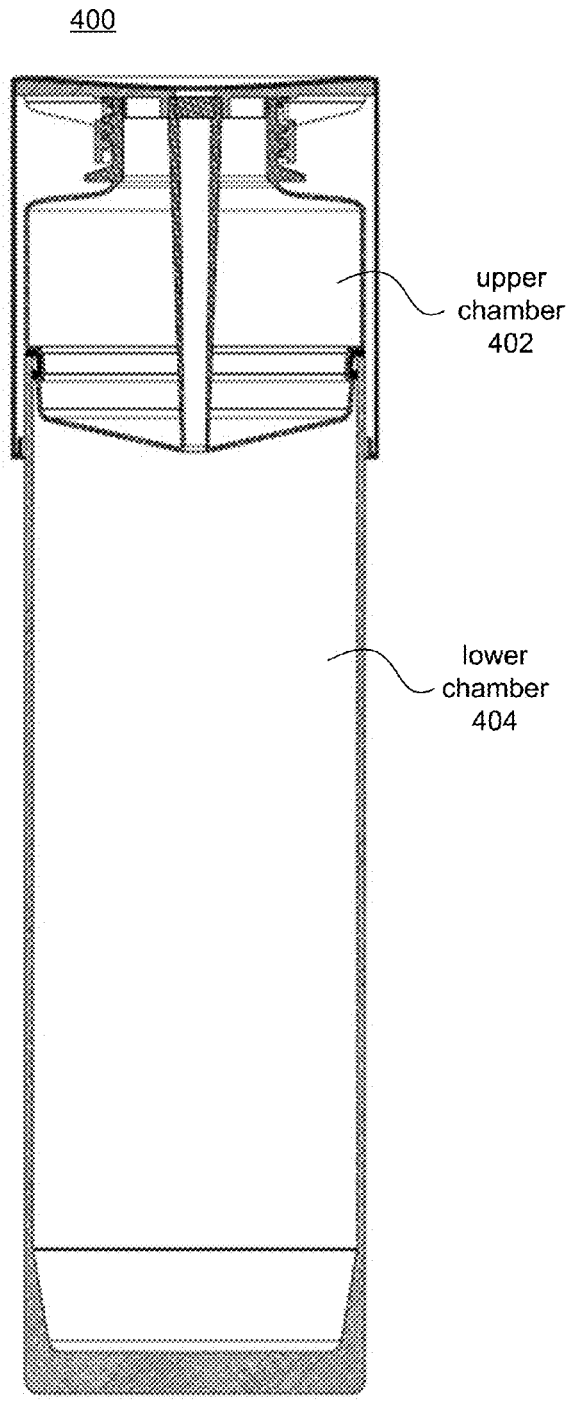
FIG. 4B is a cross sectional side view of the fourth embodiment of the multi-chambered container in a sealed state.
Figure 4C:
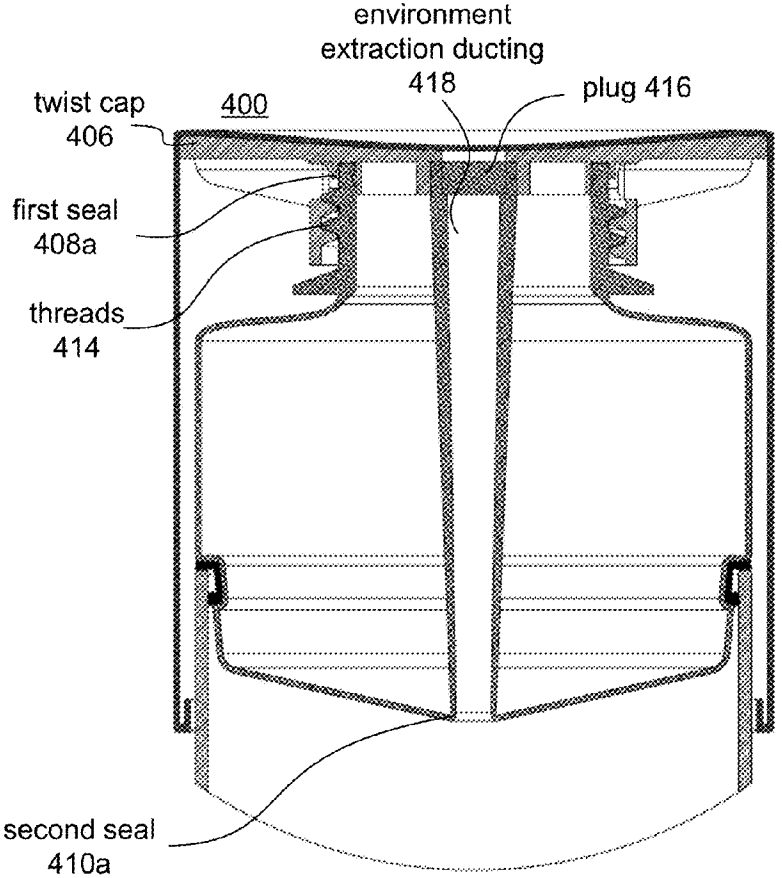
FIG. 4C is an enlarged cross sectional side view of the fourth embodiment of the multi-chambered container in a sealed state.
Figure 4D:
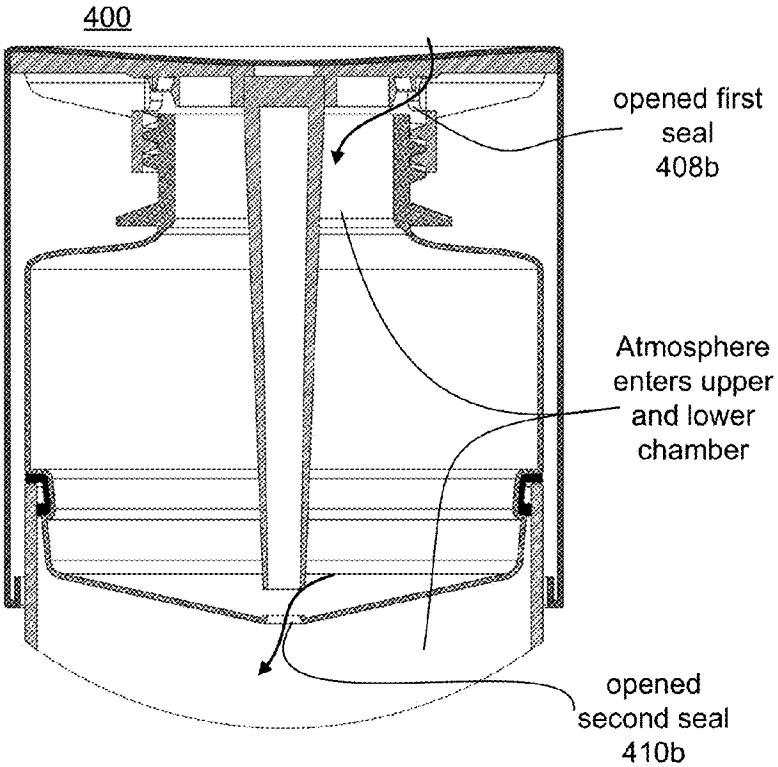
FIG. 4D is an enlarged cross sectional side view of the fourth embodiment of the multi-chambered container in an opened state.
Figure 4F:
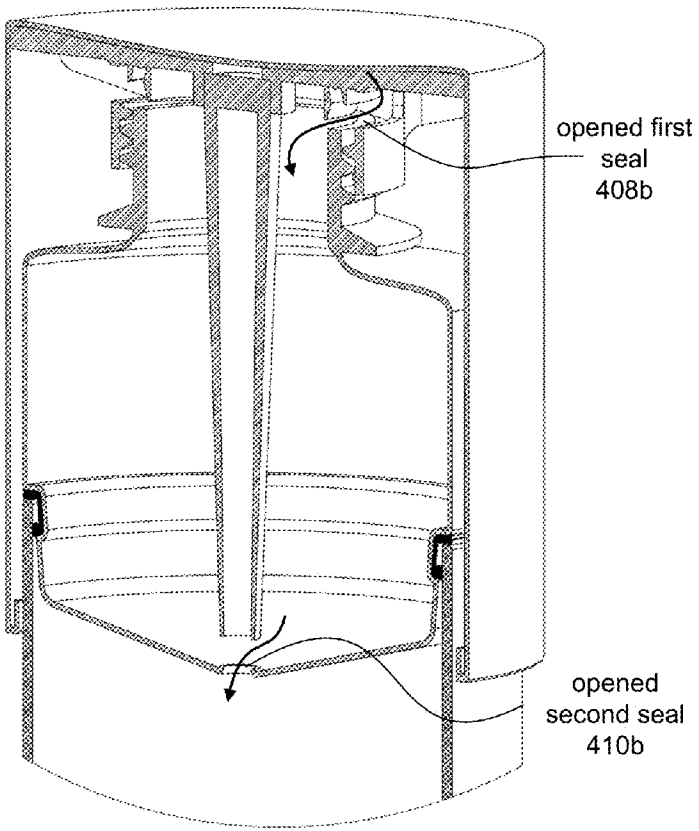
FIG. 4F is an enlarged cross sectional perspective view of the fourth embodiment of the multi-chambered container in an opened state.
Figure 4E:
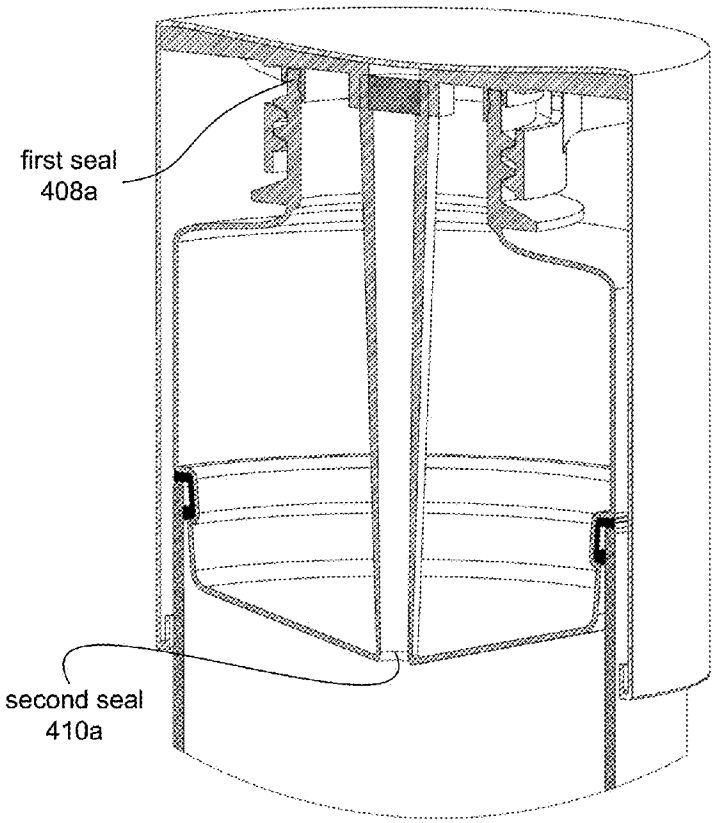
FIG. 4E is an enlarged cross sectional perspective view of the fourth embodiment of the multi-chambered container in a sealed state.

FIGS. 3A-3C illustrate different views of a third embodiment of a multi-chambered container. In this embodiment, the container 300 includes an upper chamber 302 that is part of an upper assembly of components that includes a pull tab 306 or other similar physical actuator (e.g., a device for puncturing) for opening a first tear seal 308*a*, a second tear seal 310*a*, and a load transitional member 326 physically connected to both the first 308*a* and second 310*a* seals. The first seal 308*a* prevents atmosphere from entering the upper chamber 302. The second seal 310*a* presents the contents of the upper 302 and lower 304 chambers from mixing, and also maintains the lower chamber 304 under vacuum, which at least in part keeps the upper 302 and lower 304 chambers in physical contact.

The container 300 is opened when a user provides an actuation movement to the pull tab 306 (or other similar physical actuator). The actuation movement tears the first seal 308*b*, thereby creating an opening in the upper chamber 302. The actuation movement also affects the load transitional member 326, which translates the physical actuator to the second seal 310*b*, creating an opening between the upper 302 and lower 304 chambers. The openings in both of these surfaces allows atmosphere into both chambers and also allows the substances in the chambers to mix.

The vacuum that existed in the lower chamber 304 prior to opening exerted a pressure differential on the second seal 310*a*. Upon opening, the pressure differential forces the contents of the upper chamber 302 to rapidly vacate the upper chamber 302 in favor of entering the lower chamber 304 to equalize pressure. This creates a mixing effect, resulting in the mixture of the contents of the ingredients from each of the chambers. The mixing effect yields a heterogeneous or homogeneous substance in the lower chamber 304, depending upon the type of substances mixed. Once the contents of the upper chamber 302 have emptied, the upper chamber 302 can be easily removed from the lower chamber 304 as the vacuum no longer strongly holds the upper chamber 302 in place. Once removed, the upper chamber 304 can be discarded.

V. Three or More Chamber Example Container

Figure 2:
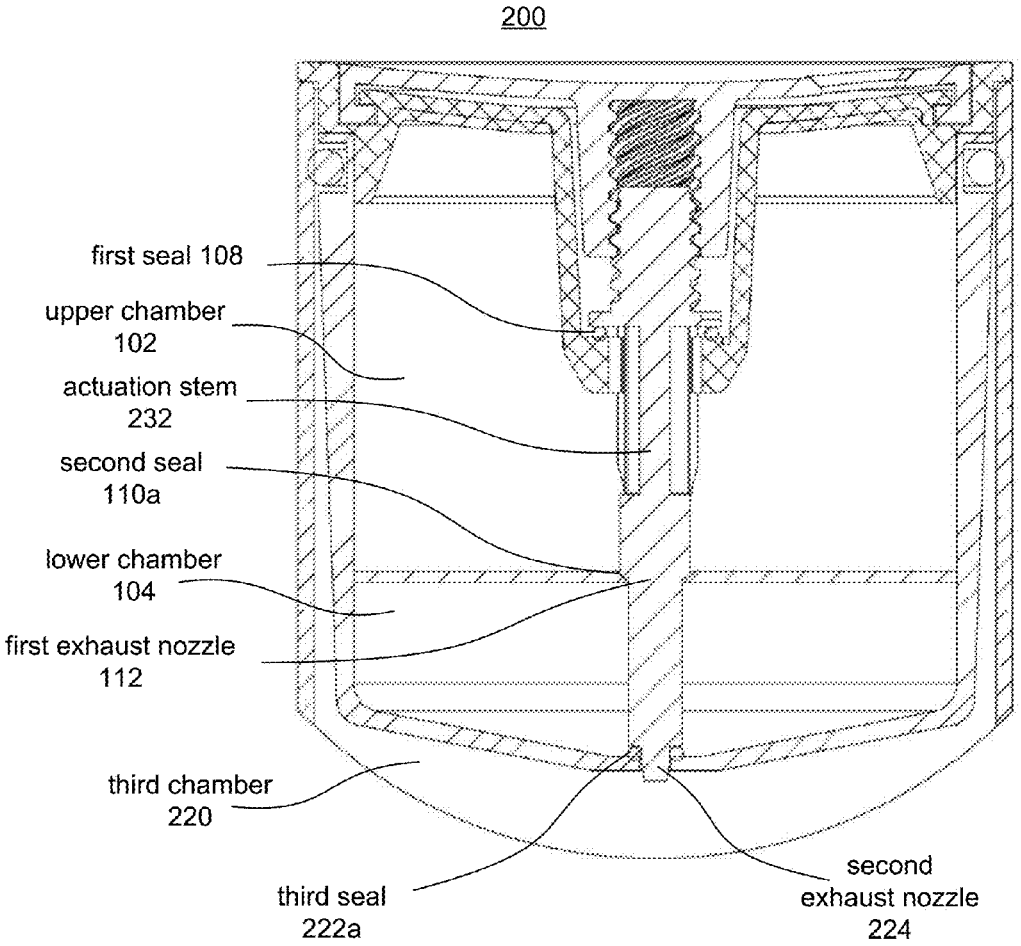
FIG. 2 is an enlarged cross sectional side view of a second embodiment of the multi-chambered container.

FIG. 2 illustrates a view of a second embodiment of a multi-chambered container. In this second embodiment, the container 200 includes more than two chambers. This second embodiment is a variant of the container discussed in the first embodiment, and so details described above for that embodiment are also applicable here, and are not repeated for brevity.

The second embodiment varies from the first embodiment in several respects. The second embodiment includes a third chamber 220 located beneath the lower chamber 104. It includes a modified actuation stem 232 that allows for formation of separate second 110 and third 222 actuation seals against the bottom surfaces of the lower 104 and third 220 chambers, respectively. A first exhaust nozzle 112, when opened, permits the contents of the upper chamber 102 and atmosphere to enter the lower chamber 104. A second exhaust nozzle 224, when opened, permits the contents of the upper chamber 102, lower chamber 104, and atmosphere to enter the third chamber 220.

Generally, in any container including more than two chambers, the bottom-most chamber is sealed having an internal pressure below atmospheric pressure, such that when the container is opened, the contents of all chambers enter the bottom-most chamber and mix there. Additionally, any other chamber may be carbonated.

As a specific example, in the second embodiment, the below-atmosphere chamber is the third chamber 220, but in practice it may be a subsequent chamber (not shown). Additionally, in some embodiments the upper assembly may include more than one chamber such as is the case in the second embodiment. In the second embodiment, the upper assembly includes the upper chamber 202 and the lower chamber 204, which is manufactured as a component separately from the third chamber 220. In practice, the upper assembly may include any number of chambers.

VI. Additional Considerations

Generally, the container is useful for storing different substances entirely separately in relatively small, predetermined volumes based on the sizes of the chambers of the container. Storage of the substances separate chambers allows for convenient transport of the substances with confidence that they will not accidentally mix. The container further allows for convenient and consistent mixing with no user effort required once the chambers are unsealed. Transportation in the vacuum provided by the chamber can also be useful in extending usable lifetime (e.g., the expiration date) of the transported substances.

The container may be used to transport a variety of different substances including chemicals (e.g., reagents, catalysts, etc.), medicine, beverages, etc. In an implementation where the container is more specifically configured to hold ingredients for a beverage, the lower chamber is designed to be an aesthetically pleasing, minimalistic end product. For example, it may lack threads or a cap and/or it does not neck down at the top, thereby resembling a traditional drinking glass.

What is claimed is:

1. A container:

an upper assembly comprising:

an upper chamber containing at least a first substance, a first seal sealing the upper chamber from atmosphere, a second seal, an environment extraction ducting, an actuation threading, and wherein the second seal is formed at a mating point between the environment extraction ducting and a bottom surface of the upper chamber;

a lower chamber physically contacting the upper chamber and sealed from the upper chamber by the second seal, wherein the lower chamber maintains physical contact with the upper chamber at least in part by the actuation threading and the lower chamber containing a pressure lower than atmospheric pressure, the pressure lower than atmospheric pressure pulling the upper chamber against the lower chamber into physical contact, and the lower chamber comprises at least a second substance different from the first substance; and a twist cap operable to at least a first state and a second state;

the first state to open both the first seal and the second seal, such that when the twist cap is rotated about the actuation threading, atmosphere enters the upper and lower chambers, and the first substance mixes with the second substance in the lower chamber, wherein the rotation of the twist cap tears the environment extraction ducting away from the bottom surface of upper chamber at the mating point to open the second seal, and the second state to decouple the upper assembly and lower chamber, such that when the twist cap is further rotated about the actuation threading, the upper assembly is removable from the lower chamber.

2. The container of claim 1 comprising:

wherein the environment extraction ducting and the bottom of the upper chamber are formed of a single piece of material prior to opening.

3. The container of claim 1, wherein the environment extraction ducting further comprises:

an opening proximate to atmosphere that is sealable by a plug, wherein the opening connects atmosphere to the lower chamber when the upper assembly and the lower chamber are mated together, and the plug sealing the environment extraction ducting by sealing the opening from atmosphere and preventing atmosphere from entering the environment extraction ducting and the lower chamber.

4. The container of claim 1 wherein the twist cap is a twist cap comprises reciprocal actuation threads;

wherein the actuation threads of the upper assembly are mated to the reciprocal actuation threads of the twist cap; and wherein rotation of the twist cap rotates the reciprocal actuation threads about the actuation threads, such that that rotation of the twist cap induces the first state causing both the first seal and the second seal to open.

5. The container of claim 1, wherein the upper chamber is carbonated.

6. The container of claim 1 wherein the mating point is engineered to fail.

7. The container of claim 1 wherein the first substance is a solid and the second substance is a liquid such that when the first and second substance mixes, the solid dissolves in the liquid.

8. The container of claim 4, wherein rotation of the twist cap induces the second state causing the reciprocal actuation threads and the actuation threads to decouple allowing the upper assembly to be removed from the lower chamber.

9. The method of claim 8, wherein the inducing the second state requires additional rotation of the twist cap from the first state.

10. The container of claim 3 wherein the environment extraction ducting allows the creation of the pressure lower than atmospheric pressure in the lower chamber before sealing the first opening with a plug.

* * * * *